US007370687B2

(12) United States Patent
Mizota et al.

(10) Patent No.: US 7,370,687 B2
(45) Date of Patent: May 13, 2008

(54) METHOD OF DETECTION OF ABNORMALITY OF SQUEEZE PIN AND MOLDING MACHINE

(75) Inventors: Yukio Mizota, Ebina (JP); Shunichiro Ito, Zama (JP)

(73) Assignee: Toshiba Kikai Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/676,565

(22) Filed: Feb. 20, 2007

(65) Prior Publication Data

US 2007/0193712 A1 Aug. 23, 2007

(30) Foreign Application Priority Data

Feb. 21, 2006 (JP) ..... 2006-043556

(51) Int. Cl.
*B22D 46/00* (2006.01)

(52) U.S. Cl. ..... 164/457; 164/120; 164/319; 164/154.2; 164/154.8; 164/155.3; 164/155.4

(58) Field of Classification Search ..... 164/457, 164/120, 319, 154.2, 154.8, 155.3, 155.4
See application file for complete search history.

(56) References Cited

U.S. PATENT DOCUMENTS 5,787,963 A * 8/1998 Tsuji et al. ..... 164/120
6,810,940 B2 * 11/2004 Tsuji et al. ..... 164/120

FOREIGN PATENT DOCUMENTS

| | | |
|---|---|---|
| JP | 07328758 | * 12/1995 |
| JP | H09-225619 | 2/1997 |
| JP | 2001-212661 | 8/2001 |
| JP | 2004154805 | * 6/2004 |

OTHER PUBLICATIONS

Korean Office Action issued in counterpart Application No. 10-2007-0016882 mailed Jan.21, 2008.
English Abstract of JP Publication No. 2001-212661, published on Aug. 7, 2001.

* cited by examiner

*Primary Examiner*—Jonathan Johnson
*Assistant Examiner*—I.-H. Lin
(74) *Attorney, Agent, or Firm*—DLA Piper US LLP

(57) ABSTRACT

A molding machine able to stably detect an abnormality of a squeeze pin, for example, a die cast machine having a squeeze pin able to apply pressure to a melt of a cavity repeatedly performing a molding cycle including a pressing process making the squeeze pin advance and applying pressure to the melt of the cavity in a state where the melt is filled in the cavity and a spray process making the squeeze pin advance and performing at least one of lubrication and cooling of the squeeze pin in the state where the melt is not filled in the cavity, and, in the spray process, detecting a stroke of the squeeze pin and detecting an abnormality of the squeeze pin based on a comparison of the detection result about the stroke and a predetermined reference value.

4 Claims, 6 Drawing Sheets

DC1

METHOD OF DETECTION OF ABNORMALITY OF SQUEEZE PIN AND MOLDING MACHINE

BACKGROUND OF THE INVENTION

1. Field of the Invention

The present invention relates to a method of detection of an abnormality of a squeeze pin and a molding machine such as die cast machine having a squeeze pin.

2. Description of the Related Art

A molding machine such as die cast machine can use a squeeze pin to apply pressure to the material being molded. The squeeze pin prevents gross porosity. Such a system is disclosed in Japanese Patent Publication (A) No. 9-225619. In such a molding machine, in order to make the squeeze pin advance toward the cavity with a proper stroke, even where galling of the squeeze pin has occurred, for example, the oil pressure or flow in a hydraulic cylinder for driving the squeeze pin has been raised or the time that the squeeze pin begins to advance in the next cycle is made earlier when the galling of the squeeze pin has occurred.

The above technology controls the operation of the squeeze pin based on various types of measurement values obtained while the squeeze pin advances in the cavity filled with molten material. In other words, galling of the squeeze pin is detected while molten material is around the squeeze pin. However, a change in the environment, such as a change in the mold temperature or oil temperature, will cause the flow and solidification state of the molten material in the cavity to differ for each shot (for each cycle). Accordingly, in the conventional detection of galling of a squeeze pin, variations arise in the operation of the squeeze pin among cycles due to the influence of the flow and solidification state of the melt around the squeeze pin, so galling of the squeeze pin cannot be stably detected. For this reason, if, for example, the occurrence of galling is accidentally detected in a cycle due to the influence of the flow etc. in the cavity, and if the time that the squeeze pin begins to advance in the next cycle is set early, an excessively large stroke of the squeeze pin will occur in the next cycle.

SUMMARY OF THE INVENTION

It is preferable to provide a method of detection of an abnormality of a squeeze pin and a molding machine capable of stably detecting the abnormality of a squeeze pin.

According to a first aspect of the present invention, there is provided a method of detection of an abnormality of a squeeze pin applying pressure in a melt of a cavity of a mold in a molding machine, including the steps of performing a molding cycle repeatedly, each molding cycle including advancing the squeeze pin and applying pressure to the melt in the cavity in a state where the melt is filled in the cavity and subsequently advancing the squeeze pin and performing at least one of lubrication and cooling of said squeeze pin where the melt is not filling said cavity, during the subsequent advancing where the melt is not filling said cavity, detecting a physical amount indicating an operation state of the squeeze pin and detecting the abnormality of the squeeze pin based on a comparison of the detected physical amount and a predetermined reference value, and executing abnormality processing in order to indicate an occurrence of the abnormality when such abnormality is detected.

According to a second aspect of the present invention, there is provided a molding machine including a clamping device to clamp a fixed mold and a moving mold, an injection device to inject melt into a cavity formed by the fixed mold and the moving mold, a squeeze pin configured to advance or retract to/from the cavity, a fluid pressure cylinder having a piston fixed to the squeeze pin and being configured to drive the squeeze pin, a fluid pressure circuit to control the flow of a working fluid supplied to a rod side cylinder chamber and a head side cylinder chamber of the fluid pressure cylinder, the rod side cylinder chamber and the head side chamber being separated by the piston, a control device configured to control operations of the clamping device, the injection device, and the fluid pressure circuit, and a sensor detecting a physical amount indicating the operation state of the squeeze pin, wherein the control device controls operations of the clamping device, the injection device, and the fluid pressure circuit so as to repeat a molding cycle including an injection process injecting a melt by the injection device into the cavity of the fixed mold and the moving mold clamped by the clamping device, an applying process making the squeeze pin advance into the cavity in which a melt is filled by the injection and applying pressure to the melt, a carrying out process opening the molds by the clamping device after the pressed melt is solidified and carrying out a molded article from the cavity, and a lubricating or cooling process causing the squeeze pin to advance and performing at least one of the lubrication and cooling of the squeeze pin before the injection process or after the carrying out process, and determines a presence of any abnormality of the squeeze pin based on a comparison of a physical amount detected by the sensor in the lubricating or cooling process and a predetermined reference value, and executes an abnormality process in order to indicate an occurrence of the abnormality when such abnormality is detected.

Preferably, the sensor detects a stroke of the squeeze pin, and the control device controls the operation of the fluid pressure circuit so that pressurized oil having a predetermined pressure is supplied into the head side cylinder chamber in the lubricating or cooling process and determines that an abnormality occurs in the squeeze pin when the stroke at the time the squeeze pin stops is smaller than the reference stroke set corresponding to the predetermined pressure.

Preferably, the sensor includes a stroke sensor detecting the stroke of the squeeze pin and a pressure sensor detecting the fluid pressure of the fluid pressure cylinder, and the control device controls the operation of the fluid pressure circuit so that pressurized oil having a constant pressure and flow is supplied into the head side cylinder chamber in the lubricating or cooling process and determines that an abnormality occurs in the squeeze pin when the pressure detected by the pressure sensor exceeds the predetermined reference pressure prior to the stroke detected by the stroke sensor reaching a predetermined reference stroke.

According to the present invention, the abnormality of a squeeze pin can be stably detected.

BRIEF DESCRIPTION OF THE DRAWINGS

These and other objects and features of the present invention will become clearer from the following description of the preferred embodiments given with reference to the attached drawings, wherein.

DESCRIPTION OF THE PREFERRED EMBODIMENTS

Figure 1:
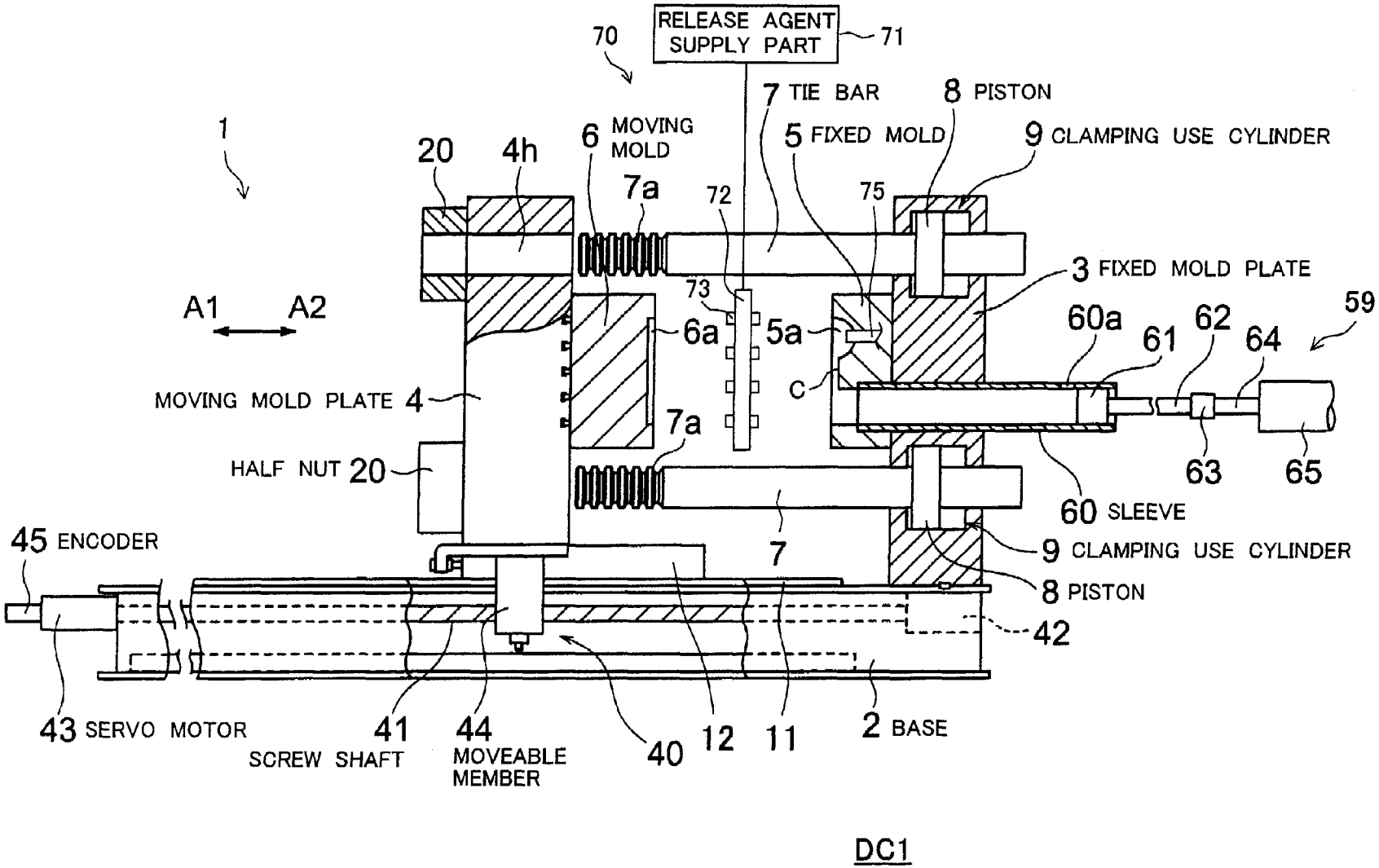
FIG. 1 illustrates a schematic view of an overall constitution of a die cast machine according to an embodiment of the present invention in an open state.

FIG. 1 illustrates a die cast machine DC1 of an embodiment of the present invention wherein the molds are in an open state. The die cast machine DC1 is provided with a clamping device 1 for clamping a fixed mold 5 and a moving mold 6 and an injection device 59 for supplying a melt into a cavity C formed by concave parts 5*a*, 6*a* etc. of the fixed mold 5 and the moving mold 6.

The clamping device 1 is configured with, for example, a composite type clamping device and is provided with a movement mechanism 40 for mainly performing the opening/closing of the molds and a clamping cylinder 9 for mainly performing the clamping.

In the opening/closing of the molds, in the movement mechanism 40, a screw shaft 41 is driven to rotate by a servo motor 43, whereby a moveable member 44 screwed with the screw shaft 41 moves in an opening direction A1 or a closing direction A2 with respect to a base 2. Therefore, a moving mold plate 4 holding the moving mold 6 moves in the opening direction A1 or the closing direction A2 with respect to a fixed mold plate 3 holding the fixed mold. The rotation of the servo motor 43 can be detected by an encoder 45.

Further, during clamping, coupled parts 7*a* of tie bars 7 may be inserted into through holes 4*h* of the moving mold plate 4 and half nuts 20 provided in the moving mold plate 4 are coupled in the state where the molds contact, pistons 8 provided at the tie bars 7 slide toward the right direction in the figure by the oil pressure in the cylinder chambers of the clamping use cylinders 9 provided in the fixed mold plate 3, and tie bars 7 extend, and thereby a clamping force is generated.

When injecting the melt into the cavity C, the melt is supplied to a sleeve 60, which is connected with the concave part 5*a* of the fixed mold 5, via a feed port 60*a*, and a plunger tip 61 slides toward the direction of the cavity C in the sleeve 60, whereby the melt is injected and filled into the cavity C. The plunger tip 61 is fixed on a front end of a plunger rod 62 which is connected with a piston rod 64 via a coupling 63, and driven by the supply of the pressurized oil into an injection cylinder 65.

The clamping device 1 is provided with a coating device 70 for coating a release agent on the fixed mold 5 and the moving mold 6. The coating device 70 is provided with a release agent supply part 71 for stocking the release agent and supplying the release agent with a predetermined pressure and an gushing part 72 for gushing the release agent supplied from the release agent supply part 71 toward matching surfaces of the fixed mold 5 and the moving mold 6. The gushing part 72 can be configured to advance/retract to/from a space between the fixed mold 5 and the moving mold 6 in the open state by an arm (not shown) and has a plurality of nozzles 73 having gushing holes facing the matching surfaces of the fixed mold 5 and the moving mold 6. A powdery or mist state release agent is gushed from the nozzles 73 and the fixed mold 5 and the moving mold 6 are coated with the release agent. The release agent acts as the lubricant and cooling agent of the squeeze pin mentioned later.

The fixed mold 5 is provided with a squeeze pin 75 for applying pressure to the melt filled in the cavity C so that it can advance/retract into/from the cavity C. Note that the squeeze pin 75 may be provided at the moving mold 6 as well.

Figure 2:
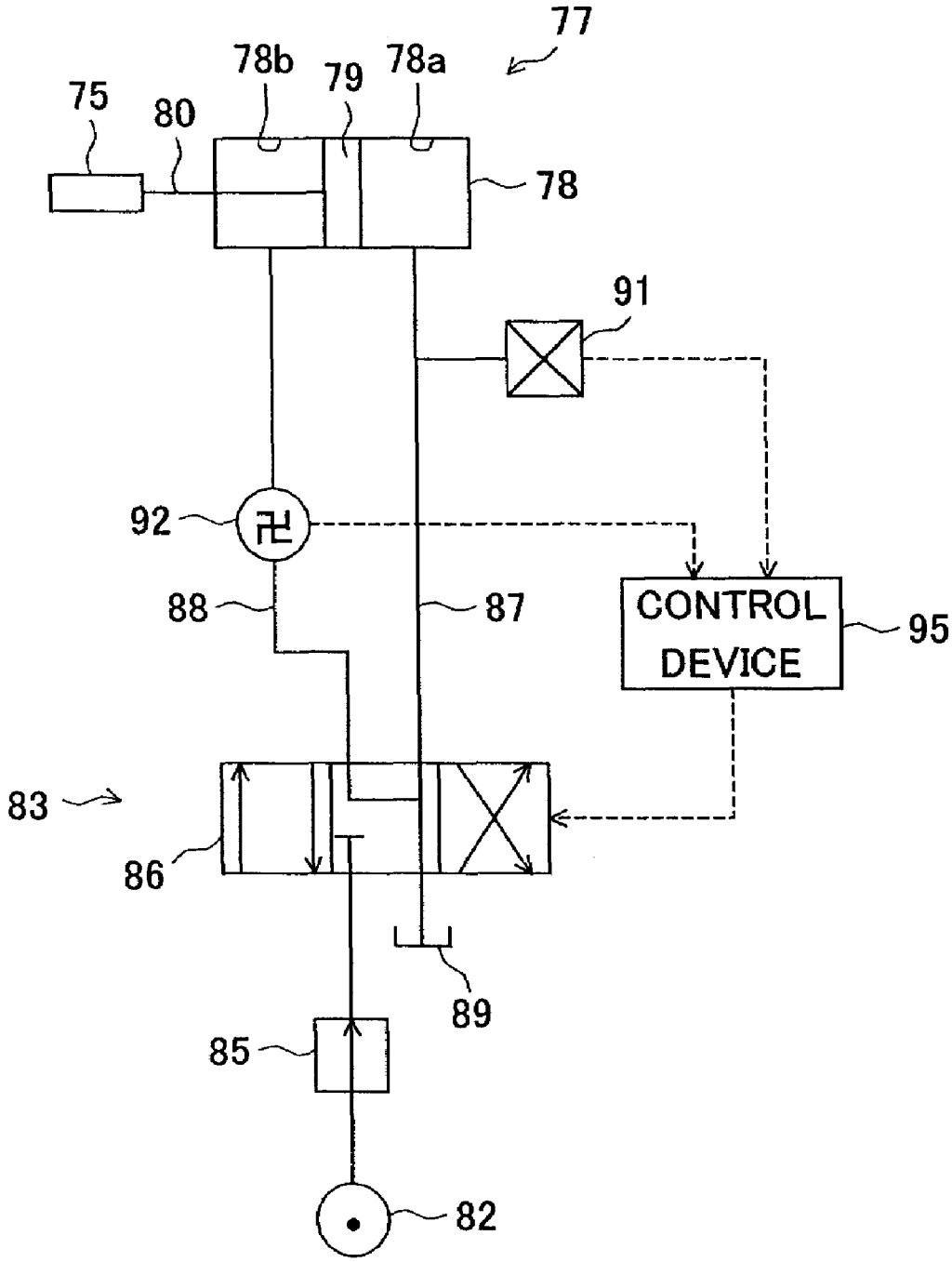
FIG. 2 illustrates a view of a drive mechanism of a squeeze pin of the die cast machine of FIG. 1.

FIG. 2 is a view showing a drive mechanism of the squeeze pin 75. The squeeze pin 75 is driven by, for example, a hydraulic cylinder device 77. Namely, the squeeze pin 75 is fixed to a piston 79 sliding in a cylinder 78 and advances/retracts into/from the cavity C by the selective supply of the pressurized oil into a head side cylinder chamber 78*a* or a rod side cylinder chamber 78*b* divided by the piston 79 of the cylinder 78. Note that, the squeeze pin 75 may be fixed via a piston rod 80 to the piston 79 as in FIG. 2 or directly fixed to the piston 79.

The flow of the pressurized oil from an oil pressure source 82 into the head side cylinder chamber 78*a* and the rod side cylinder chamber 78*b* is controlled by a hydraulic circuit 83. The hydraulic circuit 83 is provided with, for example, a pressure control valve 85 for adjusting the pressure of the pressurized oil from the oil pressure source 82 to a constant value and a direction and flow control valve 86 for switching a destination of supply of the pressurized oil from the oil pressure source 82 between the head side cylinder chamber 78*a* and the rod side cylinder chamber 78*b*. Note that the hydraulic circuit 83 is also provided with an accumulator etc. for raising the oil pressure of the pressurized oil from the oil pressure source 82, but the illustration is omitted.

The direction and flow control valve 86 functions as a for example 4-port 3-position directional control valve. At a neutral position (position at the center of the direction and flow control valve 86 in the figure), it can cut off the supply of the pressurized oil from the oil pressure source 82 into the cylinder 78 and connect an oil passageway 87 communicated with the head side cylinder chamber 78*a* and an oil passageway 88 communicated with the rod side cylinder chamber 78*b* to discharge excessive pressurized oil of the oil passageway 87 and the oil passageway 88 to a tank 89. At the position on the left side of the direction and flow control valve 86 in the figure, the oil pressure source 82 and the rod side cylinder chamber 78*b* are connected and the head side cylinder chamber 78*a* and the tank 89 are connected. At the position on the right side of the direction and flow control valve 86 in the figure, the oil pressure source 82 and the head side cylinder chamber 78*a* are connected and the rod side cylinder chamber 78*a* and the tank 89 are connected.

Further, the direction and flow control valve 86 functions as a flow control valve. For example, it controls the flow of the pressurized oil supplied from the oil pressure source 82 to the oil passageway 87 or the oil passageway 88. Note that, the direction and flow control valve 86 and the pressure control valve 85 and driven by a solenoid etc.

The oil passageway 87 connecting the head side cylinder chamber 78*a* and the direction and flow control valve 86 is provided with a pressure sensor 91 for detecting the pressure of the pressurized oil. The pressure sensor 91 detects the pressure of the pressurized oil in the head side cylinder chamber 78*a*. Further, the oil passageway 88 connecting the rod side cylinder chamber 78*b* and the direction and flow control valve 86 is provided with a flow sensor 92 for detecting the flow of the pressurized oil of the oil passageway 88. The flow sensor 92 detects the flow of the pressurized oil discharged from the rod side cylinder chamber 78*b*.

Note that the flow of the pressurized oil discharged from the rod side cylinder chamber 78*b* can be converted to the stroke of the squeeze pin 75.

Detection signals of the pressure sensor 91 and the flow sensor 92 are output to a control device 95. The control device 95 also has detection signals of various types of sensors such as the encoder 45 output to it. The control device 95 controls the operations of the servo motor 43, a not shown hydraulic circuit for supplying the pressurized oil into the clamping cylinder 9, and the hydraulic circuit 83 based on signals from various types of sensors. Further, the control device 95 determines whether or not an abnormality such as galling occurs at the squeeze pin 75 based on the detection results of the pressure sensor 91 and the flow sensor 92.

Figure 3:
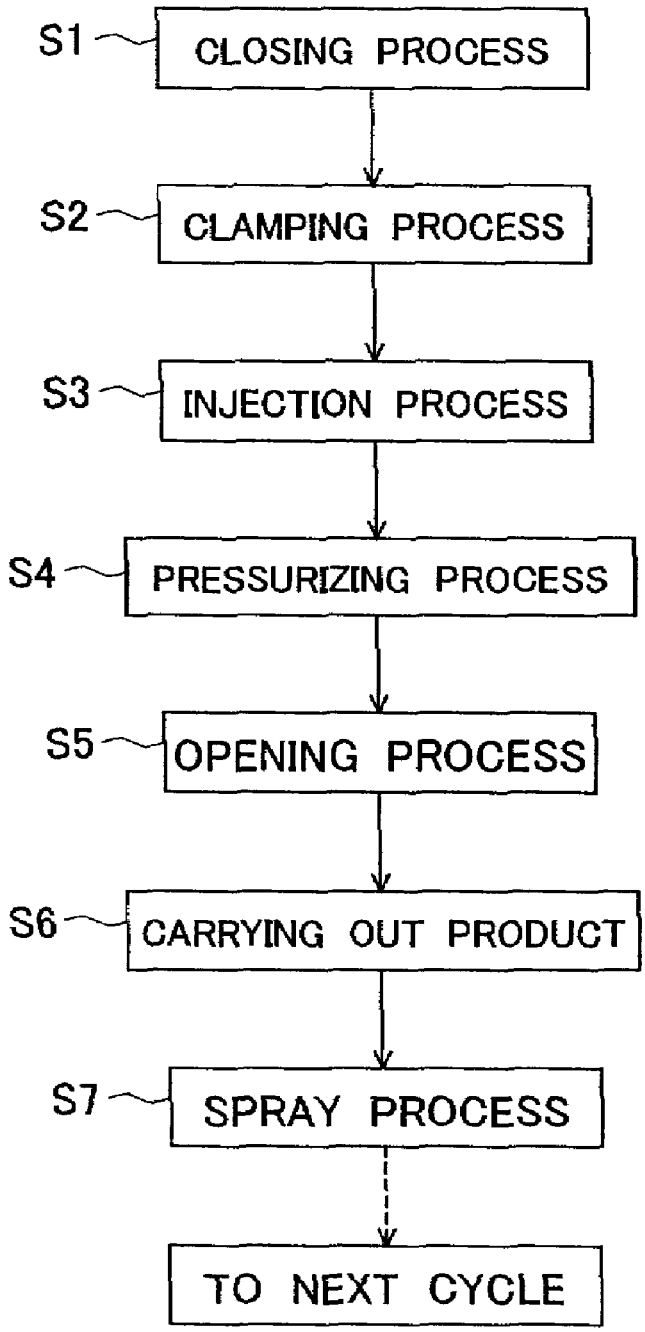
FIG. 3 is a flow chart illustrating the operation routine of the die cast machine of FIG. 1, FIGS. 4A and 4B are views illustrating an operation state and a method of detection of an abnormality of a squeeze pin of the die cast machine of FIG. 1, FIGS. 5A and 5B are views illustrating a modification of the present invention.

FIG. 3 is a flow chart showing the operation routine of the die cast machine DC1. Steps S1 to S7 of FIG. 3 show operations performed in one cycle of molding (one shot of casting) and repeatedly executed during a period where the die cast machine DC1 is operated.

At step S1, the closing process of moving the moving mold plate 4 in the closing direction A2 and bringing the fixed mold 5 and the moving mold 6 into contact is carried out. At step S2, the clamping process of clamping the fixed mold 5 and the moving mold 6 by a clamping force generated by extension of the tie bars 7 is carried out. At step S3, the injection process of injecting and filling the melt in the sleeve 60 into the cavity C by the plunger tip 61 is carried out.

At step S4, the pressing process of making the squeeze pin 75 advance into the cavity C and applying pressure to the melt in the cavity C is carried out. When the melt is solidified, the opening process of moving the moving mold plate 4 in the opening direction A1 is carried out (step S5). At this time, the molded article is ejected from the cavity C by an ejection pin (not shown in FIG. 1) and carried out (step S6). At step S7, the gushing part 72 is arranged between the fixed mold 5 and the moving mold 6 and gushes the release agent toward the concave part 5*a* of the fixed mold 5 and the concave part 6*a* of the moving mold 6 to coat the release agent.

At step S7, when the release agent is gushed from the gushing part 72, the squeeze pin 75 is arranged at the advance limit. That is, the stroke becomes the full stroke, and is projected into the cavity C. Accordingly, the release agent gushed from the gushing part 72 is coated also on the squeeze pin 75, and functions as the lubricant and cooling agent of the squeeze pin 75. Note that, the advance limit of the squeeze pin 75 is defined by, for example, the provision of a stopper engaged with the squeeze pin 75 at the fixed mold 5 or the advance limit of the piston 79 in the rod side cylinder chamber 78*b*.

Note that, step S4 is an example of the first process making the squeeze pin advance and applying pressure to the melt of the cavity in a state where the melt is filled in the cavity, and step S7 is an example of the second process making the squeeze pin advance and performing at least one of the lubrication and cooling of the squeeze pin in the state where the melt is not filled in the cavity.

Figure 4A:
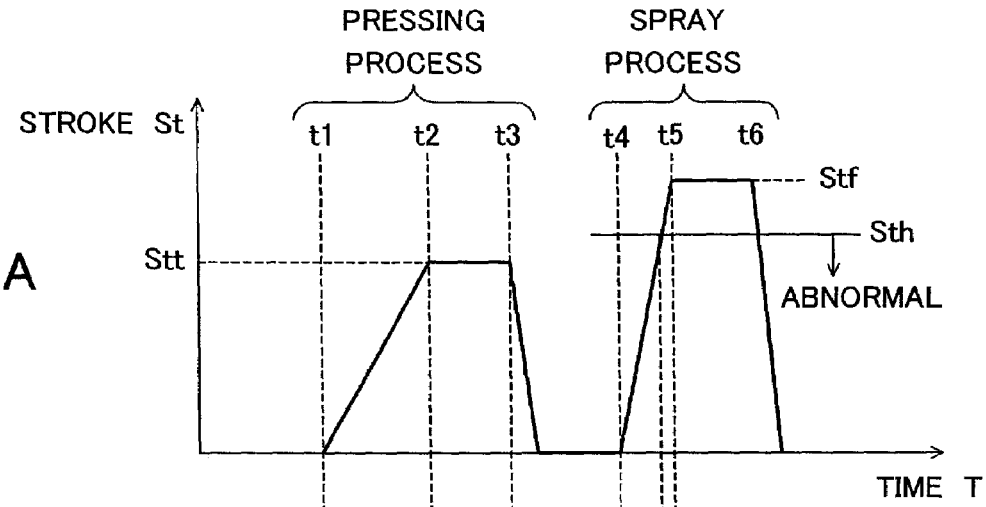
Figure 4B:
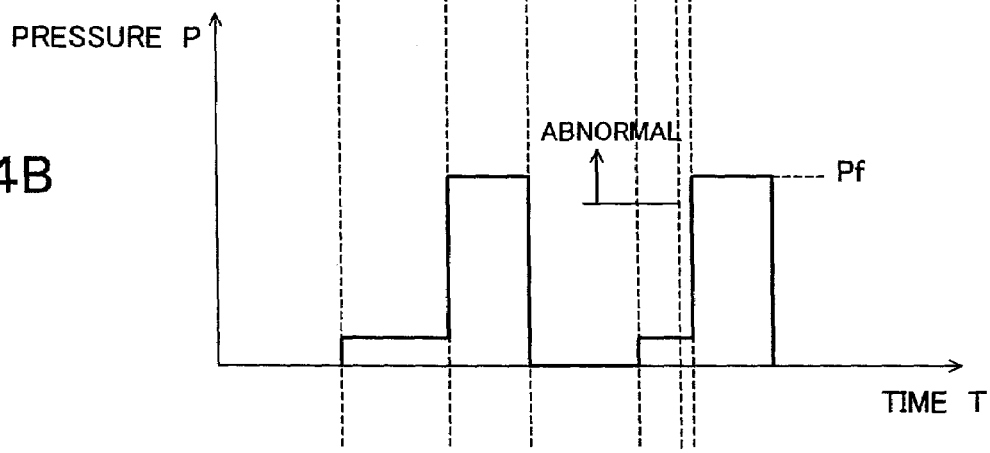

FIGS. 4A and 4B are views showing the operation state and the method of detection of an abnormality of the squeeze pin 75. Specifically, FIG. 4A shows the change of a stroke St of the squeeze pin 75 along with the elapse of time in the pressing process (step S4) and the spray process (step S7). FIG. 4B shows a change of the pressure of the head side cylinder chamber 78*a* along with the elapse of time in the pressing process and the spray process.

In the pressing process, at a time t1, the control device 95 sets the direction and flow control valve 86 at the position for supplying the pressurized oil from the oil pressure source 82 into the head side cylinder chamber 78*a* and starts the advance of the squeeze pin 75. The time t1 is set to, for example, after the elapse of a predetermined time from the completion of the injection and filling. Specifically, it is set to after the elapse of a predetermined time after the arrival of the plunger tip 61 at a predetermined position is detected by a not shown position sensor for detecting the position of the plunger tip 61 or after the elapse of a predetermined time after a pressure having a predetermined magnitude is detected by a not shown pressure sensor for detecting the pressure in the sleeve 60.

The control device 95 controls at least one of the flow and oil pressure of the pressurized oil supplied into the head side cylinder chamber 78*a* via the direction and flow control valve 86 and the pressure control valve 85 based on the stroke St specified from the detection value of the flow sensor 92 so that the stroke St of the squeeze pin 75 reaches a target value Stt at a time t2 and is held at the target value Stt until a time t3 when the melt is solidified. Note that, at the time of control of the oil pressure, the pressure detected by the pressure sensor 91 is referred to.

After the time t3, the control device 95 switches the position of the direction and flow control valve 86, supplies the pressurized oil of the oil pressure source 82 to the rod side cylinder chamber 78*b*, and retracts the squeeze pin 75. Note that, the position where the squeeze pin 75 is retracted and stopped, in other words, the reference position of measurement of the stroke St, may be set at an appropriate position up to when the piston 79 reaches the retraction limit of the head side cylinder chamber 78*a*. Further, when the position of retracting and stopping the squeeze pin 75 is defined by a stopper engaged with the squeeze pin 75 or the retraction limit of the piston 79, the squeeze pin 75 can be physically made to constantly stop at a certain position.

In the spray process, at a time t4, the control device 95 positions the direction and flow control valve 86 at the position for supplying the pressurized oil from the oil pressure source 82 into the head side cylinder chamber 78*a* and starts the advance of the squeeze pin 75. The time t4 is, for example, the time when the moving mold plate 4 reaches the opening position and is specified from the detection value of the encoder 45. Note that, the time t4 may be set to before the moving mold plate 4 reaches the opening position or may be set to after the elapse of a predetermined time after it reaches the opening position.

After the time t4, the control device 95 controls the valves in order to hold the degree of opening of the direction and flow control valve 86 constant and, at the same time, hold the set pressure of the pressure control valve 85 constant. Namely, it controls the hydraulic circuit 83 so that pressurized oil having a constant pressure and flow is supplied into the head side cylinder chamber 78*a*. Accordingly, as shown in FIG. 4A, the stroke St of the squeeze pin 75 increases in proportion to the time. Then, when the piston 79 reaches the advance limit of the rod side cylinder chamber 78*a* at a time t5, the stroke St becomes the full stroke Stf.

As shown in FIG. 4B, before the piston 79 reaches the advance limit, the piston 79 moves to the rod side cylinder chamber 78*b* side. Therefore the pressure of the head side cylinder chamber 78*a* does not become the set pressure Pf defined by the pressure control valve 85, but is held at a substantially constant value with a pressure lower than the set pressure. Then, when the piston 79 reaches the advance limit, the pressure of the head side cylinder chamber 78*a* abruptly rises and becomes the set pressure Pf defined by the pressure control valve 85.

Thereafter, the control device 95 maintains the full stroke Stf until the coating of the release agent by the coating device 70 ends, switches the position of the direction and flow control valve 86 at a time t6, supplies the pressurized oil of the oil pressure source 82 into the rod side cylinder chamber 78*b*, and retracts the squeeze pin 75.

The control device 95 determines the presence of any abnormality of the squeeze pin 75 based on the comparison of the stroke of the squeeze pin 75 specified by the flow detected by the flow sensor 92 or the pressure detected by the pressure sensor 91 during the advance of the squeeze pin (times t4 to t5) in the spray process with the predetermined reference value.

For example, when the melt is solidified and deposited on the squeeze pin 75, the squeeze pin 75 cannot be advanced up to the full stroke Stf by the thrust of the piston 79 defined from a product of the set pressure Pf and a pressure receiving area of the piston 79. Therefore, the control device 95 determines whether or not the stroke St of the squeeze pin 75 stops is larger than a predetermined judgment use stroke Sth. The control device 95 determines an abnormality occurs when judging that the former is not larger than the latter. Note that the stopping of the squeeze pin 75 can be determined by whether or not the flow detected by the flow sensor 82 becomes zero. The judgment use stroke Sth can be appropriately set in accordance with the set pressure Pf within a range smaller than the full stroke Stf by considering the detection precision or minute differences which may occur for each molding cycle due to a change etc. of the external environment.

Further, where the resistance against the advance of the squeeze pin 75 increases due to, for example, the occurrence of galling of the squeeze pin 75, before the stroke St becomes the full stroke Stf, a pressure P of the head side cylinder chamber 78*a* rises in comparison with the case where galling does not occur. Therefore, before the stroke St becomes a predetermined value relatively near the full stroke Stf (e.g. the above judgment use stroke Sth), the control device 95 determines whether or not the pressure detected by the pressure sensor 91 becomes larger than the predetermined judgment use pressure. The control device 95 determines that an abnormality occurs in the squeeze pin 75 when it is determined that the pressure detected by pressure sensor 91 is larger than the judgment use pressure. Note that, the judgment use pressure can be appropriately set within a range smaller than the set pressure Pf by considering the detection precision or the difference due to pressure fluctuations which may usually occur in the hydraulic circuit 83 etc.

Note that, the control device 95 executes predetermined abnormality processing when detecting an abnormality of the squeeze pin 75. For example, it turns on a lamp or outputs an alarm sound in order to alert the abnormality of the squeeze pin 75 to a worker. Alternatively, in the next pressing process, it controls the operation of the hydraulic circuit 83 so as to make the start time of advance of the squeeze pin 75 (time t1) earlier or make the advance speed faster so that the stroke St of the squeeze pin 75 becomes Stt before the time t2 regardless of the galling.

According to the above embodiment, the abnormality detection of the galling etc. of the squeeze pin 75 is carried out based on the stroke St of the squeeze pin 75 and the pressure P of the hydraulic cylinder device 77 when making the squeeze pin 75 advance in the state where the melt is not filled in the cavity C for lubrication and cooling of the squeeze pin 75. Therefore, the abnormality is detected based on the operation state of the squeeze pin 75 when moving the squeeze pin 75 forward with no load. Thus, the abnormality of the squeeze pin 75 can be detected without the influence of the flow and solidification state of the melt and abnormality of the squeeze pin 75 can be stably detected.

The present invention is not limited to the above embodiment and can be operated in various ways.

The molding machine may be configured as having a squeeze pin that is capable of applying pressure to the melt of the cavity of the mold. Accordingly, appropriate structures of the clamping device and the injection device may be selected. For example, the present invention is not limited to a composite type clamping device. A molding machine provided with a toggle type clamping device may be employed.

The lubrication or cooling of the squeeze pin may be accomplished by making the squeeze pin advance in the state where the melt is not filled. Accordingly, the configuration for the lubrication and cooling is not limited to coating the release agent that functions as the lubricant or cooling agent in the open state. Further, the timing of the lubrication or cooling is not limited to the period from the opening process to the clamping process and may occur prior to the completion of the injection process or after the step of carrying out the product in S6.

Figure 5A:
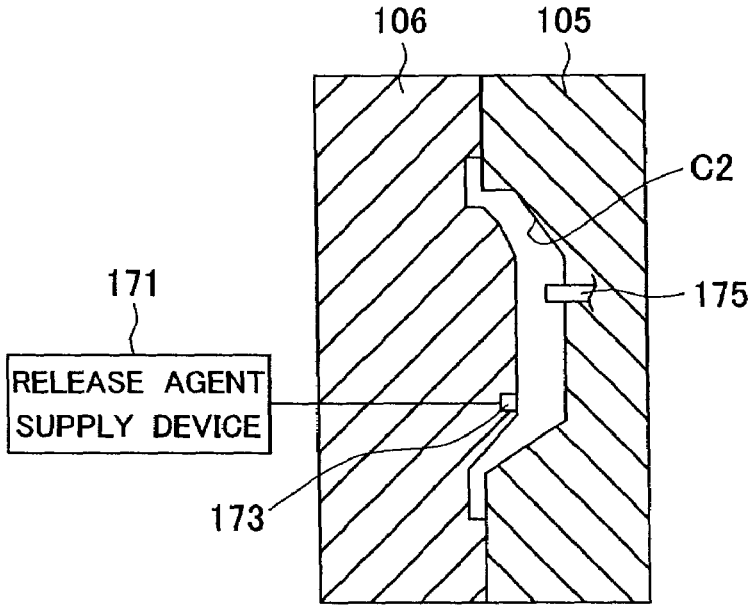

For example, as shown in FIG. 5A, before the melt is supplied into the cavity C2 formed by the clamped fixed mold 105 and moving mold 106, a squeeze pin 175 may be projected into the cavity C2 and the release agent may be supplied into the cavity C2 from a release agent supply device 171 via a nozzle 173 to coat the squeeze pin 175 with a release agent functioning as the lubrication and cooling agent.

Figure 5B:
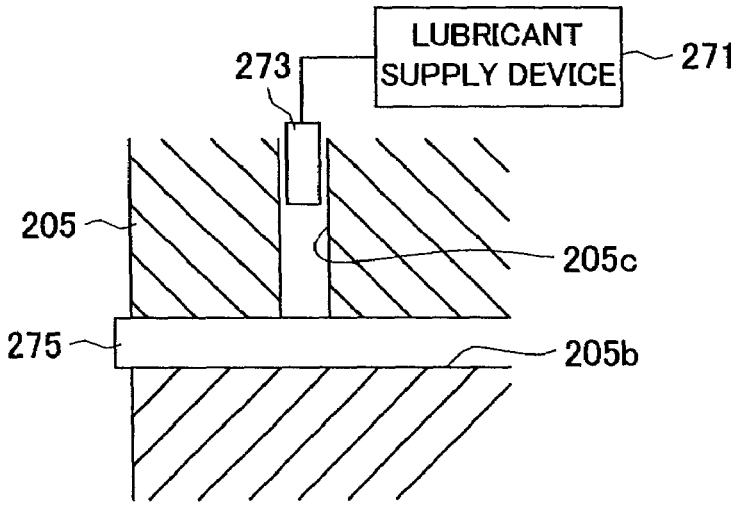

Further, as shown in FIG. 5B, a passageway 205*c* communicated with a passageway 205*b* in which a squeeze pin 275 slides may be formed in a mold 205 provided with the squeeze pin 275 and, at the timing when there is no melt in the cavity such as the opening process, the closing process, and the clamping process, the lubricant of a lubricant supply device 271 may be dropped into the passageway 205*c* via the nozzle 273 while making the squeeze pin 275 advance so as to lubricate the squeeze pin 275.

The physical amount indicating the state of operation of the squeeze pin is not limited to the stroke of the squeeze pin and the pressure of the fluid pressure cylinder for driving the squeeze pin. For example, it is possible to detect the advance speed of the squeeze pin and determine that an abnormality occurs when fluctuation of a predetermined threshold value or more occurs in the advance speed due to the galling.

When detecting an abnormality based on the stroke of the squeeze pin, the determination of the presence of an abnormality is not limited to a determination judgment based on the stroke when making the pin project. For example, it may be judged that an abnormality occurs in the squeeze pin when the stroke when retracting it from the cavity does not become zero.

When detecting an abnormality based on the pressure of the fluid pressure cylinder, the determination of the presence of an abnormality is not limited to whether or not the pressure prior to the stroke reaching a full stroke exceeds a predetermined threshold value, and is not limited to a determination based on the pressure during the advance. For example, an abnormality may occur when the pressure fluctuation during the advance has a magnitude exceeding fluctuation due to detection precision or pressure fluctuation which may usually occur in a hydraulic circuit, or an abnormality may occur during the retraction of the squeeze pin.

The methods of detection of abnormality may be appropriately selected and combined. For example, detection of an abnormality based on the stroke and the detection of an abnormality based on the pressure may be used together.

The detection of the stroke of the squeeze pin is not limited to detection according to the flow discharged from the cylinder chamber of the fluid pressure cylinder for driving the squeeze pin or the flow supplied into the cylinder chamber, and thus, may be appropriately carried out.

Figure 6A:
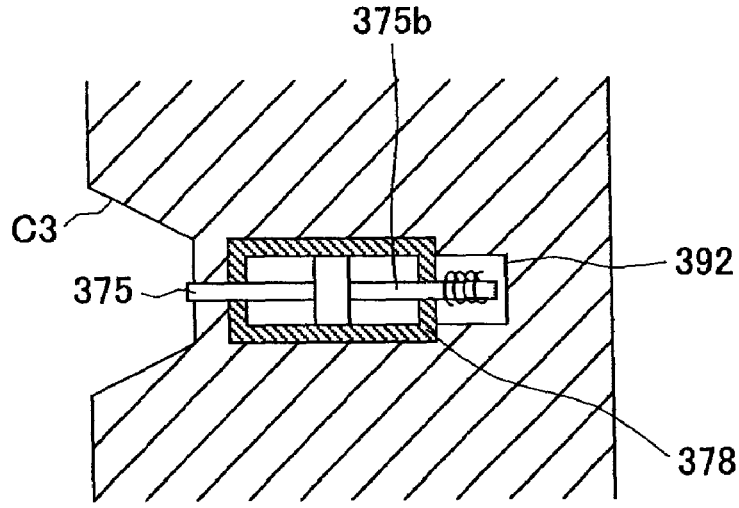
FIGS. 6A and 6B are views illustrating a modification of the present invention.

For example, as shown in FIG. 6A, it is possible to provide a rod part 375*b* extending out from a cylinder 378 at a squeeze pin 375 on the side opposite to a cavity C3 and provide a differential transformer type displacement sensor 392 for detecting the position of the squeeze pin 375 by the displacement of the rod part 375*b* with respect to a primary coil and a secondary coil.

Figure 6B:
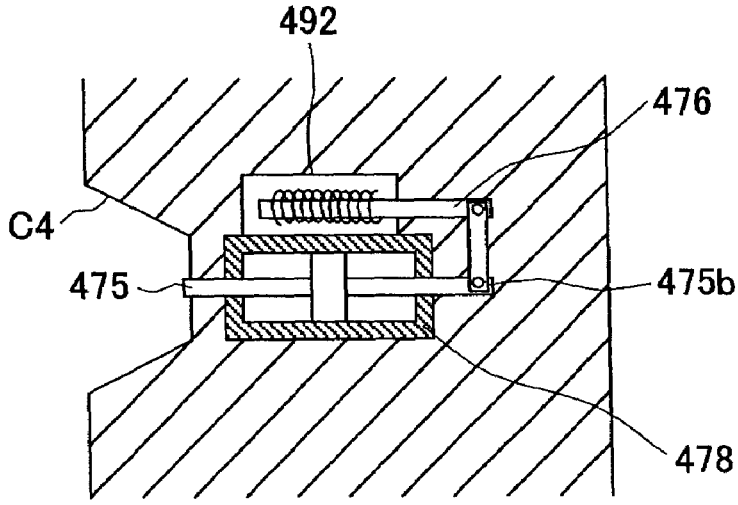

Further, as shown in FIG. 6B, it is possible to connect a moveable core 476 to a rod part 475*b* the same as the rod part 375*b* of FIG. 6A, and provide a differential transformer type displacement sensor 492 for detecting the position of a squeeze pin 475 by the displacement of the moveable core 476 with respect to a primary coil and a secondary coil.

While the invention has been described with reference to specific embodiments chosen for purposes of illustration, it should be apparent that numerous modifications could be made thereto by those skilled in the art without departing from the basic concept and scope of the invention.

What is claimed is:

1. A method of detection of an abnormality of a squeeze pin applying pressure to a melt in a cavity of a mold in a molding machine, comprising:

performing a molding cycle repeatedly, each molding cycle including advancing the squeeze pin and applying pressure to the melt in the cavity in a state where the melt is filled in the cavity and subsequently advancing the squeeze pin and performing at least one of lubrication and cooling of said squeeze pin where the melt is not filling said cavity;

during the subsequent advancing where the melt is not filling said cavity, detecting a physical amount indicating an operation state of the squeeze pin and detecting the abnormality of the squeeze pin based on a comparison of the detected physical amount and a predetermined reference value; and executing abnormality processing in order to indicate an occurrence of the abnormality when such abnormality is detected.

2. A molding machine comprising:

a clamping device to clamp a fixed mold and a moving mold;

an injection device to inject melt into a cavity formed by said fixed mold and the moving mold;

a squeeze pin configured to advance or retract to/from said cavity;

a fluid pressure cylinder having a piston fixed to said squeeze pin and being configured to drive the squeeze pin;

a fluid pressure circuit to control the flow of a working fluid supplied to a rod side cylinder chamber and a head side cylinder chamber of said fluid pressure cylinder, the rod side cylinder chamber and the head side cylinder chamber being separated by said piston;

a control device configured to control operations of said clamping device, said injection device, and said fluid pressure circuit, and a sensor detecting a physical amount indicating the operation state of said squeeze pin, wherein said control device control operations of said clamping device, said injection device, and said fluid pressure circuit so as to repeat a molding cycle including an injection process injecting a melt by said injection device into said cavity of said fixed mold and said moving mold clamped by said clamping device, an applying pressure process making said squeeze pin advance into said cavity in which a melt is filled by the injection and applying pressure to the melt, a carrying out process opening the molds by said clamping device after the pressed melt is solidified and carrying out a molded article from said cavity, and a lubricating or cooling process causing said squeeze pin to advance and performing at least one of the lubrication and cooling of said squeeze pin before said injection process or after said carrying out process, determines a presence of any abnormality of said squeeze pin based on a comparison of a physical amount detected by said sensor in said lubricating or cooling process and a predetermined reference value, and executes an abnormality process in order to indicate an occurrence of the abnormality when such abnormality is detected.

3. A molding machine as set forth in claim 2, wherein said sensor detects a stroke of said squeeze pin, and said control device controls the operation of said fluid pressure circuit so that pressurized oil having a predetermined pressure is supplied into said head side cylinder chamber in said lubricating or cooling process and determines that an abnormality occurs in said squeeze pin when said stroke at the time said squeeze pin stops is smaller than the reference stroke set corresponding to said predetermined pressure.

4. A molding machine as set forth in claim 2, wherein said sensor includes a stroke sensor detecting the stroke of said squeeze pin and a pressure sensor detecting the fluid pressure of said fluid pressure cylinder, and said control device controls the operation of said fluid pressure circuit so that pressurized oil having a constant pressure and flow is supplied into said head side cylinder chamber in said lubricating or cooling process and determines that an abnormality occurs in said squeeze pin when the pressure detected by said pressure sensor exceeds a predetermined reference pressure prior to the stroke detected by the stroke sensor reaching a predetermined reference stroke.

* * * * *